US008650903B2

(12) United States Patent
Takenaka

(10) Patent No.: US 8,650,903 B2
(45) Date of Patent: Feb. 18, 2014

(54) AIRFLOW-DIRECTION ADJUSTMENT UNIT AND HEAT SOURCE UNIT OF REFRIGERATION APPARATUS

(75) Inventor: Norihiro Takenaka, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 740 days.

(21) Appl. No.: 12/811,743

(22) PCT Filed: Jan. 7, 2009

(86) PCT No.: PCT/JP2009/050069
§ 371 (c)(1),
(2), (4) Date: Jul. 6, 2010

(87) PCT Pub. No.: WO2009/088010
PCT Pub. Date: Jul. 16, 2009

(65) Prior Publication Data

US 2010/0276116 A1 Nov. 4, 2010

(30) Foreign Application Priority Data

Jan. 8, 2008 (JP) ..... 2008-001129

(51) Int. Cl.
*F25D 17/04* (2006.01)

(52) U.S. Cl.
USPC ..... 62/404

(58) Field of Classification Search
USPC ..... 62/404, 407, 408, 454
See application file for complete search history.

(56) References Cited

U.S. PATENT DOCUMENTS

| | | | | | |
|---|---|---|---|---|---|
| 5,685,166 | A | * | 11/1997 | Li | 62/428 |
| 5,687,583 | A | * | 11/1997 | Tunekawa et al. | 62/404 |
| 5,810,658 | A | * | 9/1998 | Seo | 454/233 |
| D414,253 | S | * | 9/1999 | Kobayashi et al. | D23/351 |
| 6,029,470 | A | * | 2/2000 | Joo et al. | 62/408 |
| 6,805,984 | B2 | * | 10/2004 | Harth | 429/429 |

FOREIGN PATENT DOCUMENTS

| | | | |
|---|---|---|---|
| CN | 2662124 | Y | 12/2004 |
| CN | 1292212 | C | 12/2006 |
| JP | 61-11577 | A | 1/1986 |
| JP | 1-116334 | U | 8/1989 |
| JP | 5-71768 | A | 3/1993 |
| JP | 2001-108262 | A | 4/2001 |
| JP | 2002-267199 | A | 9/2002 |
| JP | 2005-98569 | A | 4/2005 |

OTHER PUBLICATIONS

International Preliminary Report of corresponding PCT Application No. PCT/JP2009/050069.
International Search Report of corresponding PCT Application No. PCT/JP2009/050069.

(Continued)

*Primary Examiner* — Melvin Jones
(74) *Attorney, Agent, or Firm* — Global IP Counselors

(57) ABSTRACT

An airflow-direction adjustment unit is configured to adjust a direction of air expelled to an exterior from a main body of a heat source unit of a refrigeration apparatus, the airflow-direction adjustment unit. The airflow-direction adjustment unit includes a mounting member and a closing member. The mounting member has-at least one expulsion opening arranged and configured to expel the air from the heat source unit main body. The mounting member is mounted on the heat source unit main body. The closing member is arranged and configured to block some portion of the at least one expulsion opening.

14 Claims, 11 Drawing Sheets

(56) References Cited

OTHER PUBLICATIONS

Decision of Final Rejection of corresponding Japanese Application No. 2008-334340 dated Oct. 13, 2009.

Notice of Allowance of corresponding Japanese Application No. 2008-334340 dated Mar. 16, 2010.

Office Action of corresponding Chinese Application No. 200980101749.2 dated Jul. 5, 2012.

* cited by examiner 83
83a
83b 82
82a
82b
82c
82d
82e
82f
82g
82h 86
86a
86b
86c
86d
86e
86f
86g
86h 85
85a
85b
85c
85d
85e
85f
85g
85h 84
84a
84b 83
83a
83b 82
82a
82b
82c
82d
82e
82f
82g
82h 86
86a
86b
86c
86d
86e
86f
86g
86h 85
85a
85b
85c
85d
85e
85f
85g
85h 84
84a
84b 83
83a
83b 82
82a
82b
82c
82d
82e
82f
82g
82h 86
86a
86b
86c
86d
86e
86f
86g
86h 85
85a
85b
85c
85d
85e
85f
85g
85h 84
84a
84b 83
83a
83b 82
82a
82b
82c
82d
82e
82f
82g
82h 86
86a
86b
86c
86d
86e
86f
86g
86h 85
85a
85b
85c
85d
85e
85f
85g
85h 84
84a
84b 83
83a'

82
82a'
87'

86
86a'
87'

85
85a'
87'

84
84a'
87'

AIRFLOW-DIRECTION ADJUSTMENT UNIT AND HEAT SOURCE UNIT OF REFRIGERATION APPARATUS

CROSS-REFERENCE TO RELATED APPLICATIONS

This U.S. National stage application claims priority under 35 U.S.C. §119(a) to Japanese Patent Application No. 2008-001129, filed in Japan on Jan. 8, 2008, the entire contents of which are hereby incorporated herein by reference.

TECHNICAL FIELD

The present invention relates to an airflow-direction adjustment unit, and particularly relates to an airflow-direction adjustment unit for adjusting the direction of air expelled to the exterior from the main heat source unit of a refrigeration apparatus. The present invention also relates to a heat source unit of a refrigeration apparatus provided with an airflow-direction adjustment unit.

BACKGROUND ART

Air conditioners and/or water heaters, as well as other refrigeration apparatuses are conventionally provided with an outdoor unit and/or a heat pump unit, or another heat source unit disposed outdoors. An example of such a heat source unit is disclosed in Japanese Laid-open Patent Application No. 2001-108262, wherein an outdoor unit is provided with a casing and/or a heat exchanger, a fan, or the like. In particular, the outdoor unit related to Japanese Laid-open Patent Application No. 2001-108262 has a configuration in which air expelled via the front surface of the casing is expelled from the outdoor unit from a lateral direction in order to prevent an increase in noise generated by the airflow.

SUMMARY

Technical Problem

There are occasionally directions in which air is not intended to be expelled, due to the environment in which the heat source unit is disposed. In response to this situation, the outdoor unit related to Japanese Laid-open Patent Application No. 2001-108262 can be arranged in an environment in which air is not intended to be expelled toward the front surface of the unit since, as noted above, because air is expelled to the exterior only in the lateral direction; however, complications are presented in situating the unit within environments where air is not intended to be expelled in, e.g., the lateral direction.

In view of the above, an object of the present invention is to provide an airflow-direction adjustment unit in which air from the casing of the heat source unit can be blown in a desired direction, and a heat source unit of a refrigeration apparatus provided with an airflow-direction adjustment unit.

Solution to the Problem

An airflow-direction adjustment unit according to a first aspect of the invention adjusts the direction of air expelled from a main body of a heat source unit of a refrigeration apparatus to the exterior, and comprises a mounting member and a closing member. The mounting member is mounted on the heat source unit main body and has at least one expulsion opening for air from the heat source unit main body. The closing member blocks some portion at least one of the expulsion openings.

In accordance with this airflow-direction adjustment unit, the mounting member having at least one expulsion opening is mounted on the main body of the heat source unit, and some portion at least one of the expulsion openings are blocked by the closing member. The air expelled from the heat source unit to the exterior is accordingly expelled from unblocked expulsion openings. Therefore, air can be expelled in a desired direction.

The airflow-direction adjustment unit according to a second aspect of the invention is the airflow-direction adjustment unit according to the first aspect of the invention, wherein the heat source unit main body is of a type for blowing the air to the front surface. The mounting member is a box-shaped member mounted on the front surface of the heat source unit main body. The expulsion openings are provided to two or more surfaces among a front surface, an upper surface, a lower surface, and two side surfaces of the mounting member.

In accordance with this airflow-direction adjustment unit, some portion at least one of the expulsion openings provided to two or more surfaces of the mounting member are suitably blocked by the closing member, whereby the direction of air expelled from the main body of the heat source unit to the front surface can be changed to a desired direction.

The airflow-direction adjustment unit according to a third aspect of the invention is the airflow-direction adjustment unit according to the first or second aspect of the invention, wherein the closing member is at least partially supported by the mounting member. The closing member blocks the expulsion opening by moving in a relative manner with regard to the mounting member.

In accordance with this airflow-direction adjustment unit, the closing member moves relative to the mounting member to suitably block the expulsion opening. Accordingly, there is no requirement to confirm the environmental state around the arrangement position of the heat source unit in advance and form the closing member in accordance with the confirmation result. The expulsion openings can be suitably blocked in a flexible and rapid manner in accordance with the environmental state when the heat source unit is arranged.

A heat source unit of a refrigeration apparatus according to a fourth aspect of the invention comprises an airflow-direction adjustment unit and a heat source unit main body. The airflow-direction adjustment unit is the airflow-direction adjustment unit according to any the first to third aspects of the invention. In the heat source unit main body, the direction of air expelled to the exterior is adjusted by the airflow-direction adjustment unit. A heat exchanger and a fan are accommodated in the heat source unit main body. The heat exchanger exchanges heat with air. The fan delivers the air that has undergone heat exchange in the heat exchanger to the expulsion opening.

In accordance with this heat source unit of a refrigeration apparatus, the air that has undergone heat exchange is expelled from the heat source unit via the expulsion openings that are not blocked by the closing member of the airflow-direction adjustment unit. Therefore, the heat source unit can blow out air heated by, e.g., heat exchange, in a desired direction.

The heat source unit of a refrigeration apparatus according to the fifth aspect of the invention is the heat source unit of a refrigeration apparatus of the fourth aspect of the invention, wherein the heat source unit main body and at least a portion of the mounting member in the airflow-direction adjustment unit are integrally formed.

Advantageous Effects of Invention

In accordance with the airflow-direction adjustment unit of the first aspect, air can be expelled in a desired direction because the air from the heat source unit is expelled from unblocked expulsion openings.

In accordance with the airflow-direction adjustment unit of the second aspect, some portion at least one of the expulsion openings provided in two or more surfaces of the mounting member are suitably blocked by the closing member, whereby the direction of the air expelled from the main body of the heat source unit to the front surface can be changed to a desired direction.

In accordance with the airflow-direction adjustment unit of the third aspect, there is no requirement to confirm the environmental state around the arrangement position of the heat source unit in advance and foam the closing member in accordance with the confirmation result. The expulsion openings can be suitably blocked in a flexible and rapid manner in accordance with the environmental state when the heat source unit is arranged.

In accordance with the heat source unit of a refrigeration apparatus of the fourth and fifth aspects, the heat-exchanged air is expelled to the exterior of the heat source unit via the expulsion openings that are not blocked by the closing member of the airflow-direction adjustment unit. Therefore, the heat source unit can blow out air heated by, e.g., heat exchange, in a desired direction.

BRIEF DESCRIPTION OF THE DRAWINGS

FIG. 4(*b*) is a view of the right side surface of the outdoor unit of the present embodiment.

FIG. 4(*c*) is a view of the left side surface of the outdoor unit of the present embodiment.

FIG. 4(*d*) is a view of the upper surface of the outdoor unit of the present embodiment.

FIG. 4(*e*) is a view of the lower surface of the outdoor unit of the present embodiment.

FIG. 5(*b*) is a view of the right side surface of the outdoor unit in (a-1) of another embodiment (a).

FIG. 5(*c*) is a view of the left side surface of the outdoor unit in (a-1) of another embodiment (a).

FIG. 5(*d*) is a view of the upper surface of the outdoor unit in (a-1) of another embodiment (a).

FIG. 5(*e*) is a view of the lower surface of the outdoor unit in (a-1) of another embodiment (a).

FIG. 6(*b*) is a view of the right side surface of the outdoor unit in (a-2) of another embodiment (a).

FIG. 6(*c*) is a view of the left side surface of the outdoor unit in (a-2) of another embodiment (a).

FIG. 6(*d*) is a view of the upper surface of the outdoor unit in (a-2) of another embodiment (a).

FIG. 6(*e*) is a view of the lower surface of the outdoor unit in (a-2) of another embodiment (a).

FIG. 7(*b*) is a view of the right side surface of the outdoor unit in (a-3) of another embodiment (a).

FIG. 7(*c*) is a view of the left side surface of the outdoor unit in (a-3) of another embodiment (a).

FIG. 7(*d*) is a view of the upper surface of the outdoor unit in (a-3) of another embodiment (a).

FIG. 7(*e*) is a view of the lower surface of the outdoor unit in (a-3) of another embodiment (a).

FIG. 8(*b*) is a view of the right side surface of the outdoor unit in another embodiment (c).

FIG. 8(*c*) is a view of the left side surface of the outdoor unit in another embodiment (c).

FIG. 8(*d*) is a view of the upper surface of the outdoor unit in another embodiment (c).

FIG. 8(*e*) is a view of the lower surface of the outdoor unit in another embodiment (c).

FIG. 10(*b*) is a view of the airflow-direction adjustment unit 208 according to another embodiment (e), and shows a portion of a longitudinal section of the airflow-direction adjustment unit 208 for the case in which the closing member 287 has blocked each of the expulsion openings 82*a* to 82*d*.

FIG. 11(*b*) is a view of the airflow-direction adjustment unit 308 according to another embodiment (e), and shows a portion of a longitudinal section of the airflow-direction adjustment unit 308 for the case in which the closing member 387 has blocked each of the expulsion openings 82*a* to 82*d*.

DETAILED DESCRIPTION OF EMBODIMENT(S)

The airflow-direction adjustment unit according to an embodiment of the present invention and the heat source unit of a refrigeration apparatus provided with the airflow-direction adjustment unit are described in detail below with reference to the drawings.

(1) Configuration

Figure 1:
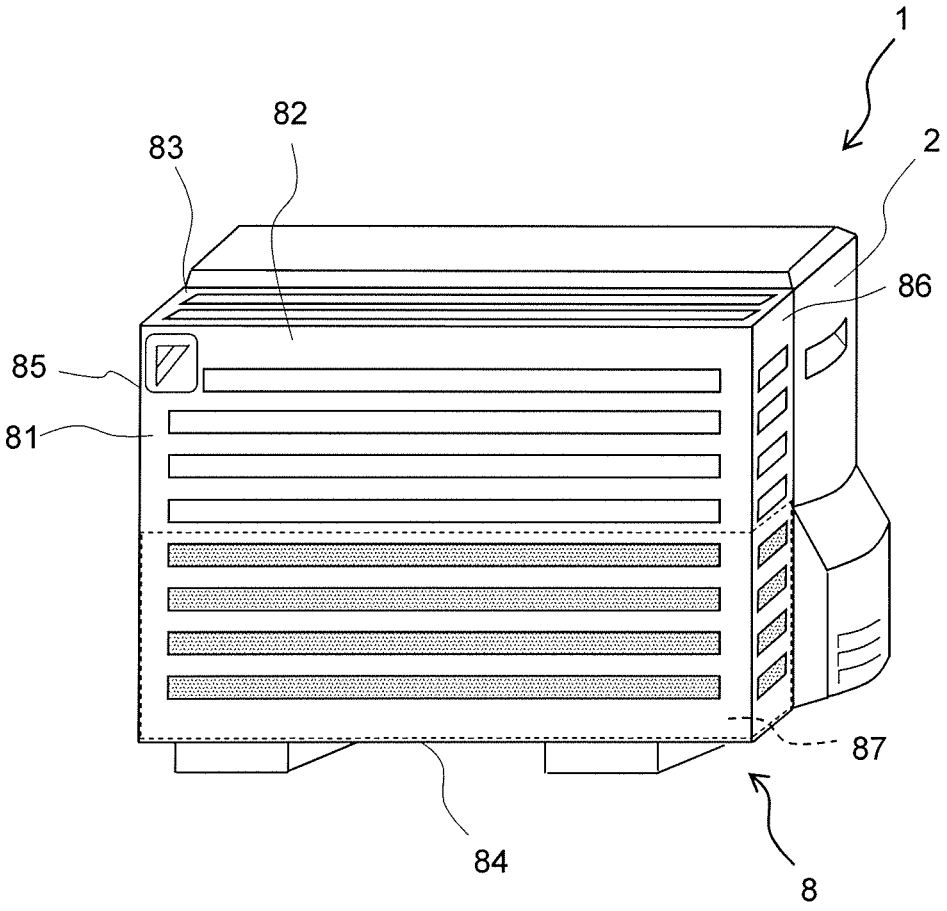
FIG. 1 is a view of the external appearance of the outdoor unit of the present embodiment.

FIG. 1 is a view of the external appearance of the outdoor unit in which the heat source unit of a refrigeration apparatus of the present embodiment has been used. The outdoor unit 1 of FIG. 1 is connected via a refrigerant tube (not shown) to an indoor unit (not shown) mounted on an indoor wall or the like, and constitutes an air conditioning apparatus (corresponding to the refrigeration apparatus). The air conditioning apparatus can carry out indoor air cooling operation and/or air warming operation, and other operations.

Figure 2:
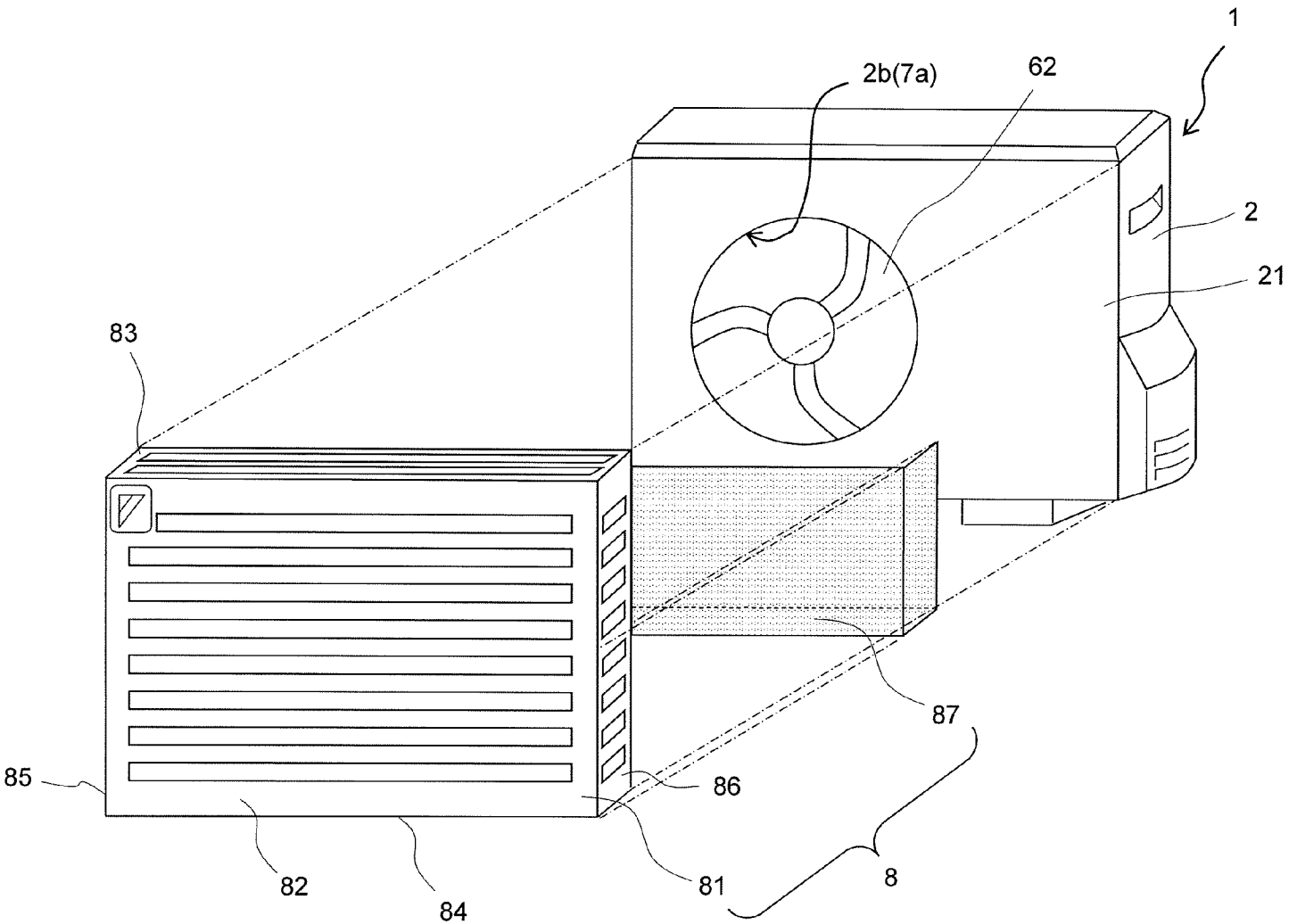
FIG. 2 is an exploded perspective view of the outdoor unit of the present embodiment.
Figure 3:
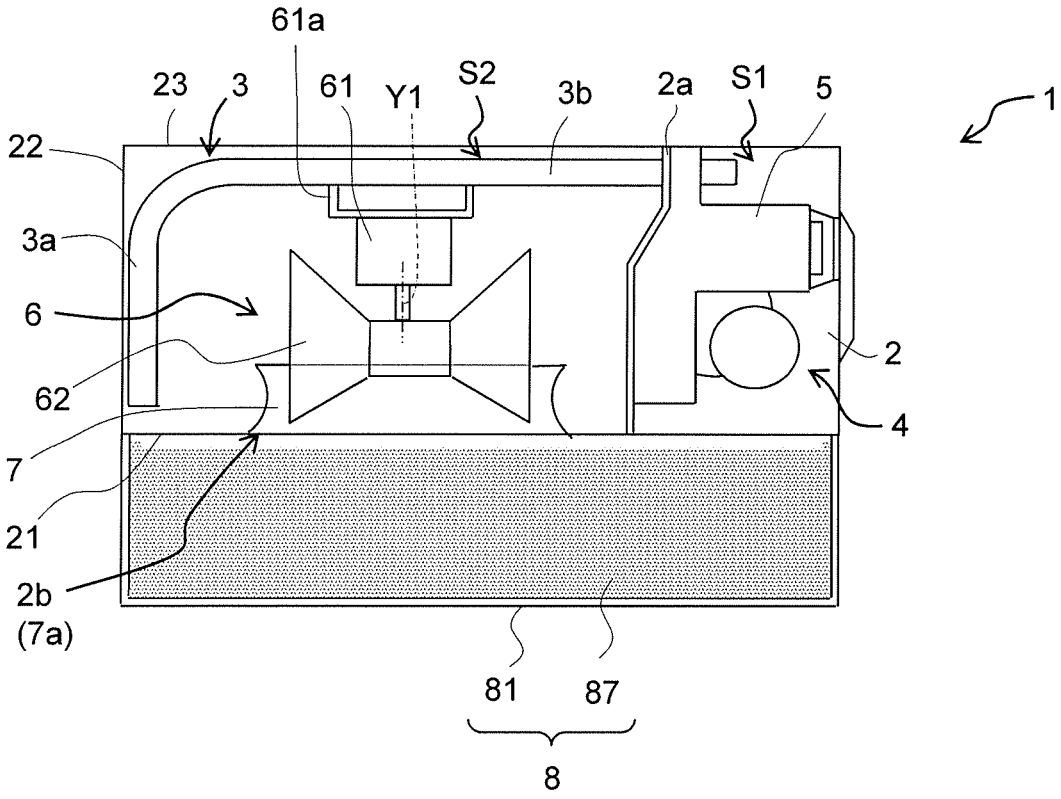
FIG. 3 is a structural view of the interior of the outdoor unit of the present embodiment as seen from above.

The outdoor unit 1 according to the present embodiment is mainly provided with a casing 2 (corresponding to the heat source unit main unit), an outdoor heat exchanger 3, a compressor 4, an electrical components unit 5, an air-feed section 6, a bell mouth 7, and an airflow-direction adjustment unit 8, as shown in FIGS. 1 to 3.

In the description below, the terms "above," "below," "right," "left," "perpendicular," and other expressions indicating direction are used where appropriate, such terms expressing directions in which the outdoor unit 1 is arranged outdoors as shown in FIG. 1, and is in an ordinary state of use.

(Casing)

The casing 2 has a substantially rectangular parallelepiped shape, as shown in FIGS. 1 and 2, and is formed using sheet metal and resin. The interior of the casing 2 is divided into a machine chamber S1 and an air-feed chamber S2 by a partition plate 2*a* that extends substantially vertically, as shown in FIG. 3. The compressor 4 and the electrical components unit 5 are disposed in the machine chamber 51, and the outdoor heat exchanger 3 and the air-feed section 6 are disposed in the air-feed chamber S2.

An air-feed port 2*b* and an intake port (not shown) are formed in the casing 2. The air-feed port 2*b* is formed in the front surface 21 of the casing 2 and has a substantially circular shape, as shown in FIG. 2. Air from the air-feed port 2*b* is expelled from the interior of the casing 2 to the exterior. The air is eventually expelled to the exterior of the outdoor unit 1, and when the air is expelled to the exterior of the outdoor unit 1, it is blown in the direction adjusted by the airflow-direction adjustment unit 8, described further below. The intake port is formed in the back surface 23 of the casing 2 and in the left side surface 22 of the casing 2 as viewed from above, as shown in FIG. 3.

(Outdoor Heat Exchanger)

The outdoor heat exchanger 3 exchanges heat with air taken into the casing 2 via the intake port. The outdoor heat exchanger 3 is substantially L-shaped and is arranged so as to conform to the left side surface 22 and the back surface 23 of the casing 2. More specifically, the outdoor heat exchanger 3 has a first portion 3*a* extending along the left side surface 22 and a second portion 3*b* extending along the back surface 23 of the casing 2. In other words, the first portion 3*a* extends substantially parallel to the rotating center shaft Y1 of the fan 62 included in the air-feed section 6, and the second portion 3*b* extends substantially parallel to the direction substantially orthogonal to the rotating center shaft Y1 of the fan 62.

Such an outdoor heat exchanger 3 has a heat transfer tube (not shown) folded back a plurality of times at the two ends in the lengthwise direction, and a fin section (not shown) that includes a plurality of fins through which the heat-transfer tube is inserted. The heat transfer tube is connected to a refrigerant tube (not shown), and refrigerant that flows inside the refrigerant tube (not shown) flows into the heat transfer tube.

(Compressor)

The compressor 4 compresses the refrigerant that flows inside the refrigerant tube (not shown) and is arranged inside the machine chamber S1. More specifically, the compressor 4 is arranged near the partition plate 2*a* and below the electrical components unit 5 inside the machine chamber S1. The compressor 4 is driven by a compressor motor.

(Electrical Components Unit)

The electrical components unit 5 accommodates a control board on which capacitors and transistors, and a plurality of other electrical components are mounted; and a reactor and the like; and is arranged on the upper side of the compressor 4 in the machine chamber S1. A plurality of harnesses extend from the control board inside the electrical components unit 5. These harnesses transmit drive control signals and the like to the compressor 4 and/or a fan motor 61 in the air-feed section 6; and extend from the electrical components unit 5 to the compressor 4, the fan motor 61, and the like.

(Air-Feed Section)

The air-feed section 6 feeds air that has undergone heat exchange in the outdoor heat exchanger 3 to the airflow-direction adjustment unit 8 via the air-feed port 2*b* of the casing 2, and is disposed in the air-feed chamber S2. The air-feed section 6 has the fan motor 61 and the fan 62.

The fan motor 61 is the rotational drive source of the fan 62, and is secured to a fan motor base 61*a* mounted on the back surface 23 of the casing 2. The output shaft of the fan motor 61 is connected to the rotating center shaft of the fan 62. Therefore, when the fan motor 61 rotates based on a drive control signal outputted from the control board of the electrical components unit 5, the fan 62 can rotate because the rotation is transmitted to the rotating center shaft Y1 of the fan 62 via the output shaft of the fan motor 61.

The fan 62 is a propeller fan having a plurality of blades, and is disposed in a position that corresponds to the air-feed port 2*b* of the casing 2 so that air in the air-feed chamber S2 can be expelled to the exterior. The fan 62 is caused to rotate by the fan motor 61, whereby an airflow can be generated so that air that has undergone heat exchange in the outdoor heat exchanger 3 flows to the front surface 21 side of the casing 2.

(Bell Mouth)

The bell mouth 7 is correspondingly provided with respect to the fan 62 and the air-feed port 2*b* of the casing 2. The bell mouth 7 is secured to the casing 2, and an aperture 7*a* for directing the flow of air formed by the fan 62 to the exterior of the casing 2 (i.e., the airflow-direction adjustment unit 8) is formed in the bell mouth 7. The aperture 7*a* has a substantially circular shape and is substantially the same size as the air-feed port 2*b* of the casing 2 (FIG. 2).

(Airflow-Direction Adjustment Unit)

The airflow-direction adjustment unit 8 adjusts the direction of air expelled from the interior of the casing 2 to the exterior of the casing 2, and is mounted on the casing 2 so as to cover the front surface 21 of the casing 2. The work for mounting the casing 2 of the airflow-direction adjustment unit 8 may be carried out by, e.g., a technician when the outdoor unit 1 is actually installed outdoors, or may be carried out by a factory worker when the outdoor unit 1 is manufactured (i.e., before the outdoor unit 1 is shipped). The airflow-direction adjustment unit 8 comprises a mounting member 81 and a closing member 87.

Figures 4A, 4B, 4C, 4D, 4E:
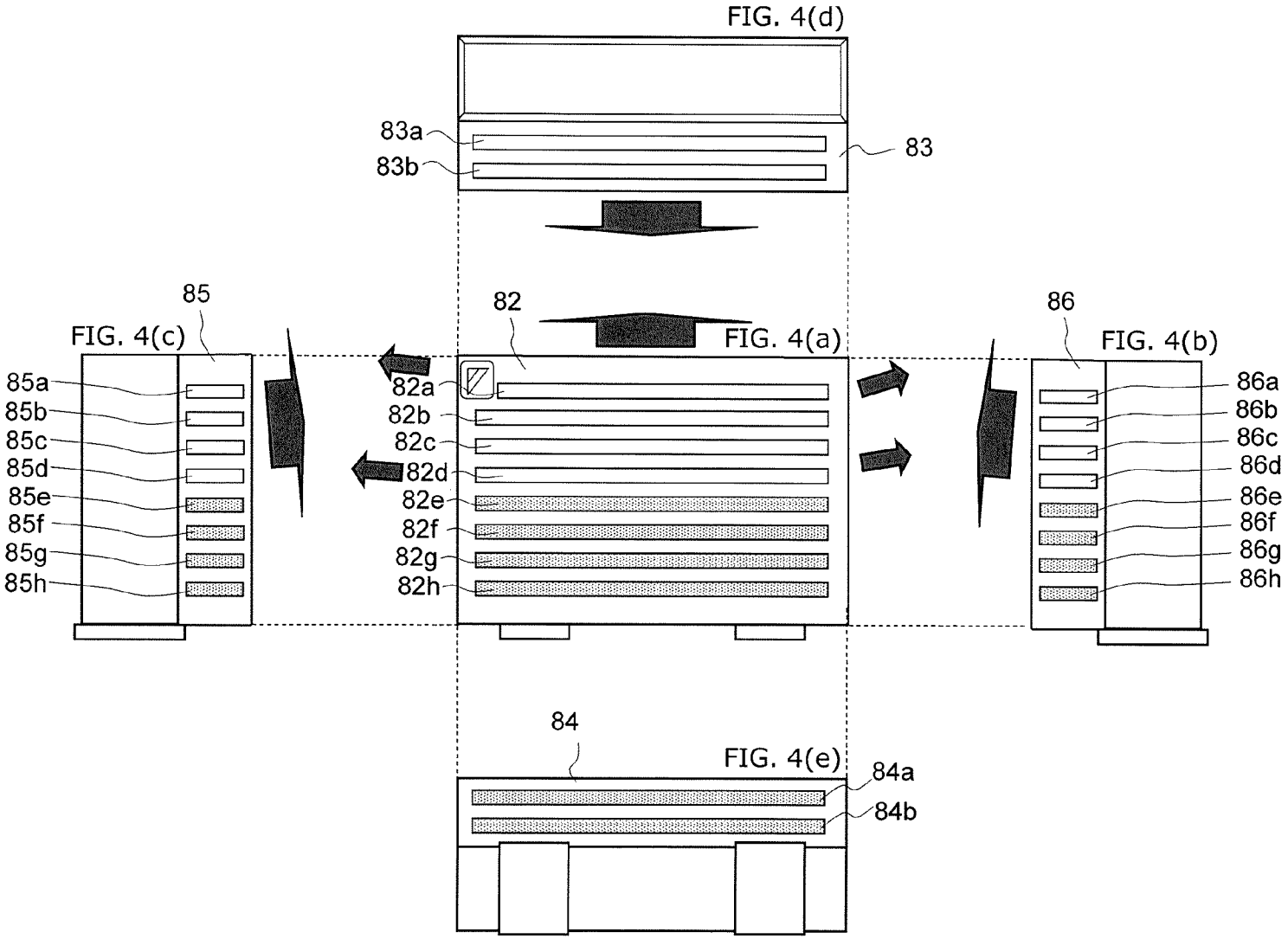
FIG. 4(*a*) is a view of the front surface of the outdoor unit of the present embodiment.

The mounting member 81 is box-shaped and is mounted on the front surface 21 of the casing 2. More specifically, the mounting member 81 has a front surface 82, an upper surface 83, a lower surface 84, a left side surface 85, and a right side surface 86, as shown in FIGS. 1 and 2, and is formed using, e.g., sheet metal. A plurality of expulsion openings 82*a* to 82*h*, 83*a* and 83*b*, 84*a* and 84*b*, 85*a* to 85*h*, 86*a* to 86*h* are formed in the surfaces 82 to 86 of the mounting member 81 (FIG. 4). More specifically, eight expulsion openings 82*a* to 82*h*, 85*a* to 85*h*, 86*a* to 86*h* are formed in the front surface 82, the left side surface 85, and the right side surface 86, respectively, of the mounting member 81. Two expulsion openings 83*a* and 83*b*, 84*a* and 84*b* are formed in the upper surface 83 and the lower surface 84, respectively, of the mounting member 81. The expulsion openings 82*a* to 82*h*, 83*a* and 83*b*, 84*a* and 84*b*, 85*a* to 85*h*, 86*a* to 86*h* are apertures via which air is expelled from the casing 2 to the exterior of the outdoor unit 1, and each expulsion opening has a rectangular shape in the present embodiment.

The closing member 87 blocks some portion at least one of the expulsion openings 82*a* to 82*h*, 83*a* and 83*b*, 84*a* and 84*b*, 85*a* to 85*h*, 86*a* to 86*h* in the mounting member 81, and is arranged between the casing 2 and the mounting member 81. In the present embodiment, the case in which the closing member 87 blocks the lower portion of the mounting member 81 is used as an example, as shown in FIG. 1. More specifically, the closing member 87 blocks the expulsion openings 82*e* to 82*h* positioned in the lower portion (i.e., the lower half) of the front surface 82 of the mounting member 81, the expulsion openings 84*a*, 84*b* of the lower surface 84, and the expulsion openings 85*e* to 85*h*, 86*e* to 86*h* positioned in the lower portion (i.e., the lower half) of each of the left side surface 85 and the right side surface 86, as shown in FIG. 4. Accordingly, the closing member 87 has a shape formed by the front surface, the lower surface, and the two side surfaces (FIG. 2). In particular, the front surface and the two side surfaces of the closing member 87 have substantially the same size as the horizontal half of the front surface 82 and the two side surfaces 85, 86, respectively, of the mounting member 81. The lower surface of the closing member 87 has substantially the same size as the lower surface 84 of the mounting member 81. The closing member 87 is arranged so that the front surface and the two side surfaces of the closing member 87 are in contact with the lower half of the front surface 82 and the two side surfaces 85, 86, respectively, of the mounting member 81, and the lower surface of the closing member 87 is in contact with the lower surface 84 of the mounting member 81 (FIG. 2). In this case, the closing member 87 is formed from a material, e.g., sheet metal, that does not readily transmit air.

When an airflow-direction adjustment unit 8 of such description is mounted on the front surface 21 of the casing 2, the air-feed port 2*b* of the front surface 21 of the casing 2 is covered by the airflow-direction adjustment unit 8. Among the expulsion openings 82*a* to 82*h*, 83*a* and 83*b*, 84*a* and 84*b*, 85*a* to 85*h*, 86*a* to 86*h* in the mounting member 81 of the airflow-direction adjustment unit 8, the expulsion openings 82*e* to 82*h*, 84*a* and 84*b*, 85*e* to 85*h*, 86*e* to 86*h* positioned in the lower half of the mounting member 81 are blocked by the closing member 87, but the expulsion openings 82*a* to 82*d*, 83*a* and 83*b*, 85*a* to 85*d*, 86*a* to 86*d* positioned in the upper half of the mounting member 81 are not blocked. Accordingly, the air expelled from the interior of the casing 2 via the air-feed port 2*b* is expelled from the unblocked expulsion openings 82*a* to 82*d*, 83*a* and 83*b*, 85*a* to 85*d*, 86*a* to 86*d* to the exterior of the outdoor unit 1, as shown by the arrow in FIG. 4. Therefore, the outdoor unit 1 according to the present embodiment has a front-blow-type casing 2, and air is not blown below the outdoor unit 1 and is mainly blown above the outdoor unit 1 because of the airflow-direction adjustment unit 8.

(2) Effects (A)

The airflow-direction adjustment unit 8 according to the present embodiment is provided with the mounting member 81 and the closing member 87, and adjusts the direction of air expelled from the casing 2 of the outdoor unit 1 to the exterior. The mounting member 81 is mounted on the casing 2 and has a plurality of expulsion openings 82*a* to 82*h*, 83*a* and 83*b*, 84*a* and 84*b*, 85*a* to 85*h*, 86*a* to 86*h*. The closing member 87 blocks some portion at least one of the expulsion openings 82*a* to 82*h*, 83*a* and 83*b*, 84*a* and 84*b*, 85*a* to 85*h*, 86*a* to 86*h* (specifically, the expulsion openings 82*e* to 82*h*, 84*a* and 84*b*, 85*e* to 85*h*, 86*e* to 86*h*). The air expelled from the outdoor unit 1 to the exterior is thereby expelled from the unblocked expulsion openings 82*a* to 82*d*, 83*a* and 83*b*, 85*a* to 85*d*, 86*a* to 86*d*.

(B)

The airflow-direction adjustment unit 8 according to the present embodiment is mounted on the front surface of the front-blow-type casing 2. In particular, the expulsion openings 82*a* to 82*h*, 83*a* and 83*b*, 84*a* and 84*b*, 85*a* to 85*h*, 86*a* to 86*h* in the mounting member 81 of the airflow-direction adjustment unit 8 are provided to the front surface 82, the upper surface 83, the lower surface 84, and the two side surfaces 85, 86, respectively, of the mounting member 81. Therefore, in accordance with this airflow-direction adjustment unit 8, the direction of air expelled to the front surface 21 of the casing 2 of the outdoor unit 1 can be changed to a desired direction by suitably blocking the expulsion openings 82*a* to 82*h*, 83*a* and 83*b*, 84*a* and 84*b*, 85*a* to 85*h*, 86*a* to 86*h* provided to a plurality of surfaces of the mounting member 81.

(C)

The outdoor unit 1 is provided with a casing 2 in which an outdoor heat exchanger 3 and a fan 62 are accommodated. In accordance with this outdoor unit 1, air that has undergone heat exchange in the outdoor heat exchanger 3 is expelled from the outdoor unit 1 via the expulsion openings 82*a* to 82*d*, 83*a* and 83*b*, 85*a* to 85*d*, 86*a* to 86*d* that are not blocked by the closing member 87 of the airflow-direction adjustment unit 8.

Other Embodiments

(a)

In the embodiment described above, the case in which the expulsion openings 82*e* to 82*h*, 84*a* and 84*b*, 85*e* to 85*h*, 86*e* to 86*h* positioned in the lower half of the mounting member 81 are blocked is used as an example. However, the expulsion openings blocked by the closing member 87 are not limited thereto. In other words, in the airflow-direction adjustment unit 8, a portion of the expulsion openings 82*a* to 82*h*, 83*a* and 83*b*, 84*a* and 84*b*, 85*a* to 85*h*, 86*a* to 86*h* of the mounting member 81 can be blocked by the closing member 87 in accordance with the environment in which the outdoor unit 1 is disposed. Therefore, the air inside the casing 2 can be expelled in a desired direction. Other examples of the embodiment described above are provided in (a-1) to (a-3) below.

Figures 5A, 5B, 5C, 5D, 5E:
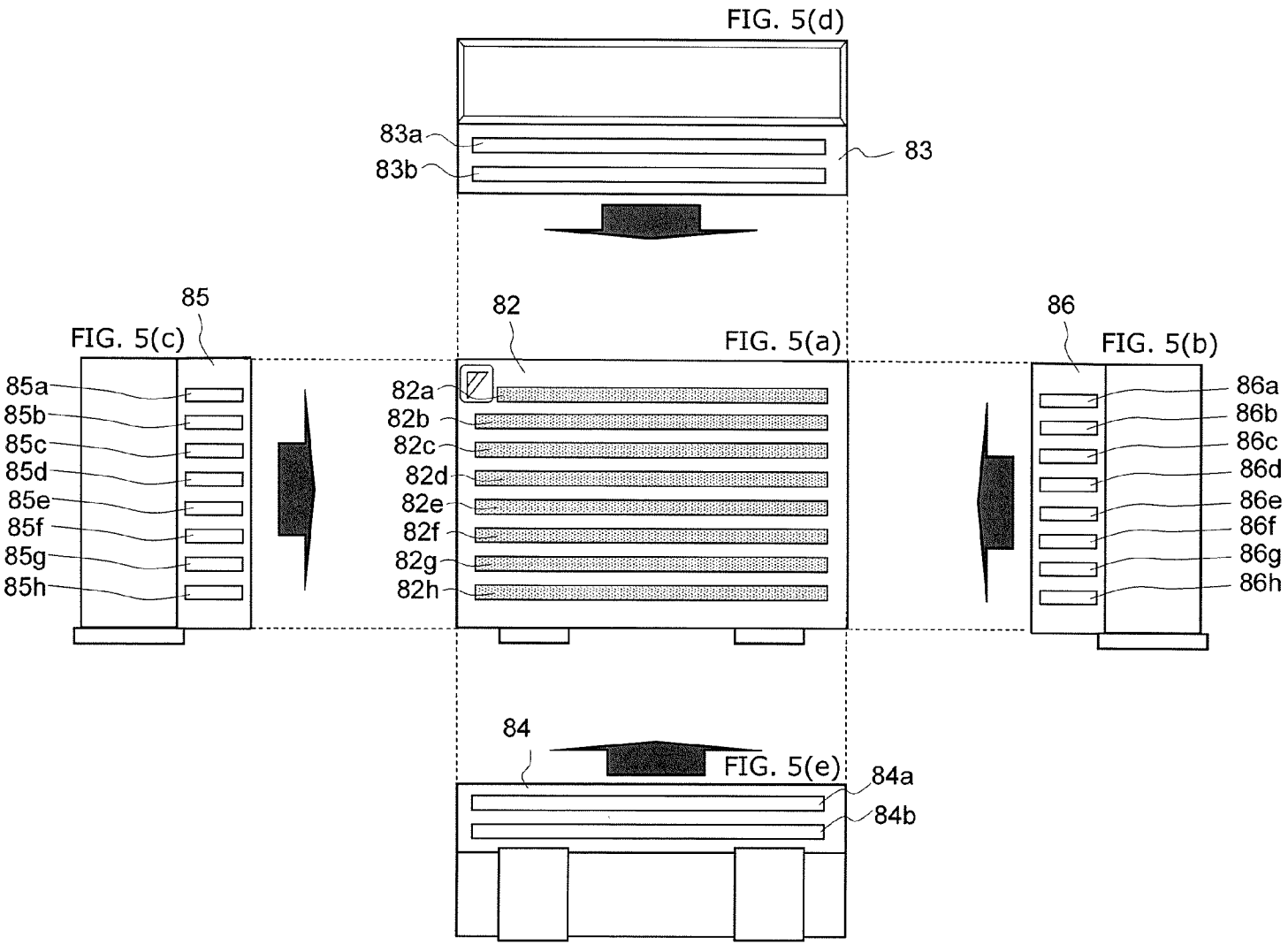
FIG. 5(*a*) is a view of the front surface of the outdoor unit in (a-1) of another embodiment (a).

(a-1) Blocking of all Expulsion Openings in the Front Surface of the Mounting Member FIG. 5 shows the outdoor unit 1 for the case in which all of the expulsion openings 82*a* to 82*h* in the front surface 82 of the mounting member 81 have been blocked by the closing member 87. According to this outdoor unit 1, air from the casing 2 is expelled through the unblocked expulsion openings 83*a* and 83*b*, 84*a* and 84*b*, 85*a* to 85*h*, 86*a* to 86*h* of the upper surface 83, the lower surface 84, and the two side surfaces 85, 86 of the mounting member 81, as indicated by the arrow in FIG. 5.

Figures 6A, 6B, 6C, 6D, 6E:
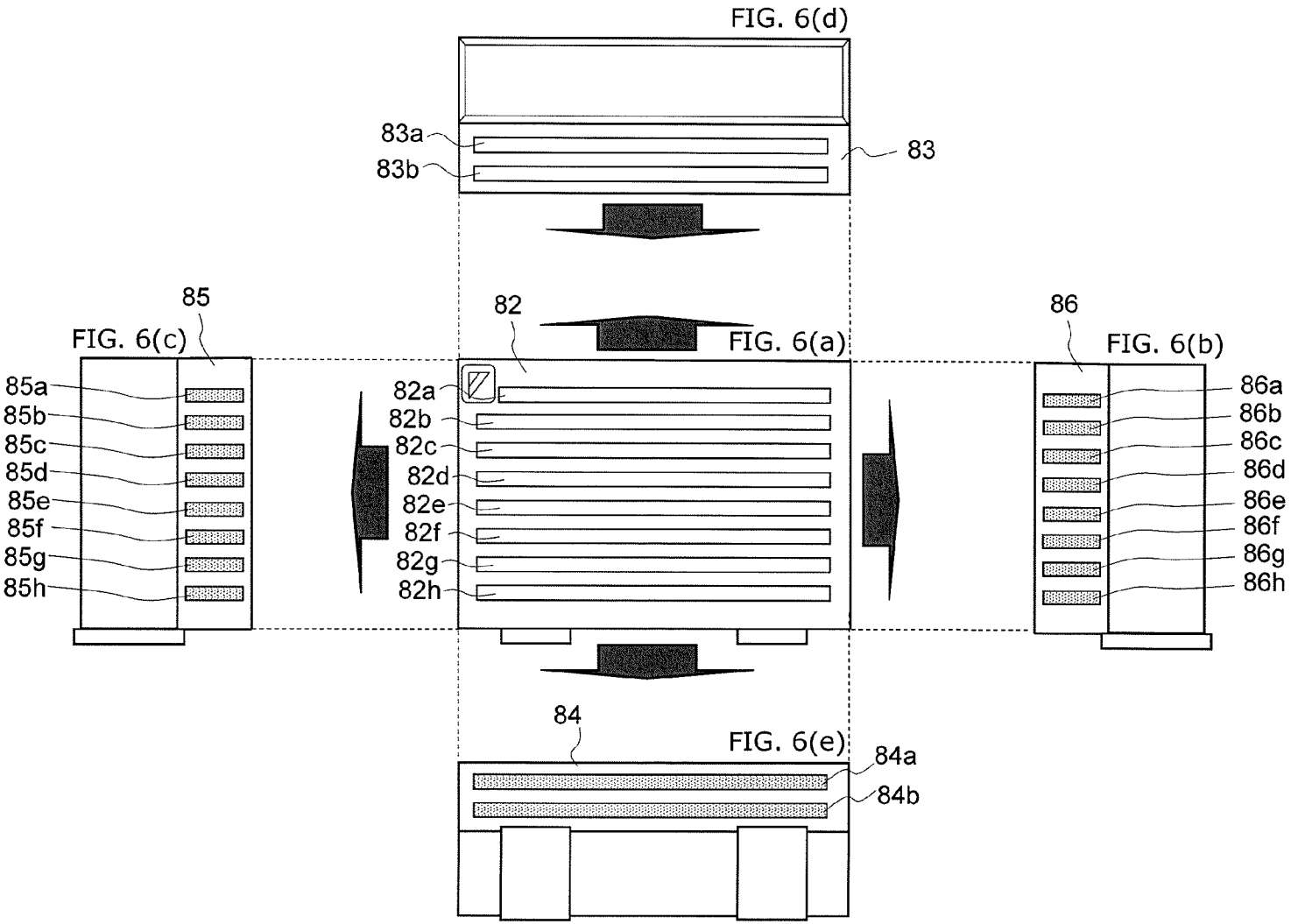
FIG. 6(*a*) is a view of the front surface of the outdoor unit in (a-2) of another embodiment (a).

(a-2) Blocking of all Expulsion Openings in the Two Side Surfaces and the Lower Surface of the Mounting Member FIG. 6 shows the outdoor unit 1 for the case in which all of the expulsion openings 84*a* and 84*b*, 85*a* to 85*h*, 86*a* to 86*h* in the lower surface 84 and the two side surfaces 85, 86 of the mounting member 81 have been blocked by the closing member 87. According to this outdoor unit 1, air from the casing 2 is expelled from the unblocked expulsion openings 82*a* to 82*h*, 83*a* and 83*b* of the front surface 82 and the upper surface 83 of the mounting member 81, as indicated by the arrow in FIG. 6.

Figures 7A, 7B, 7C, 7D, 7E:
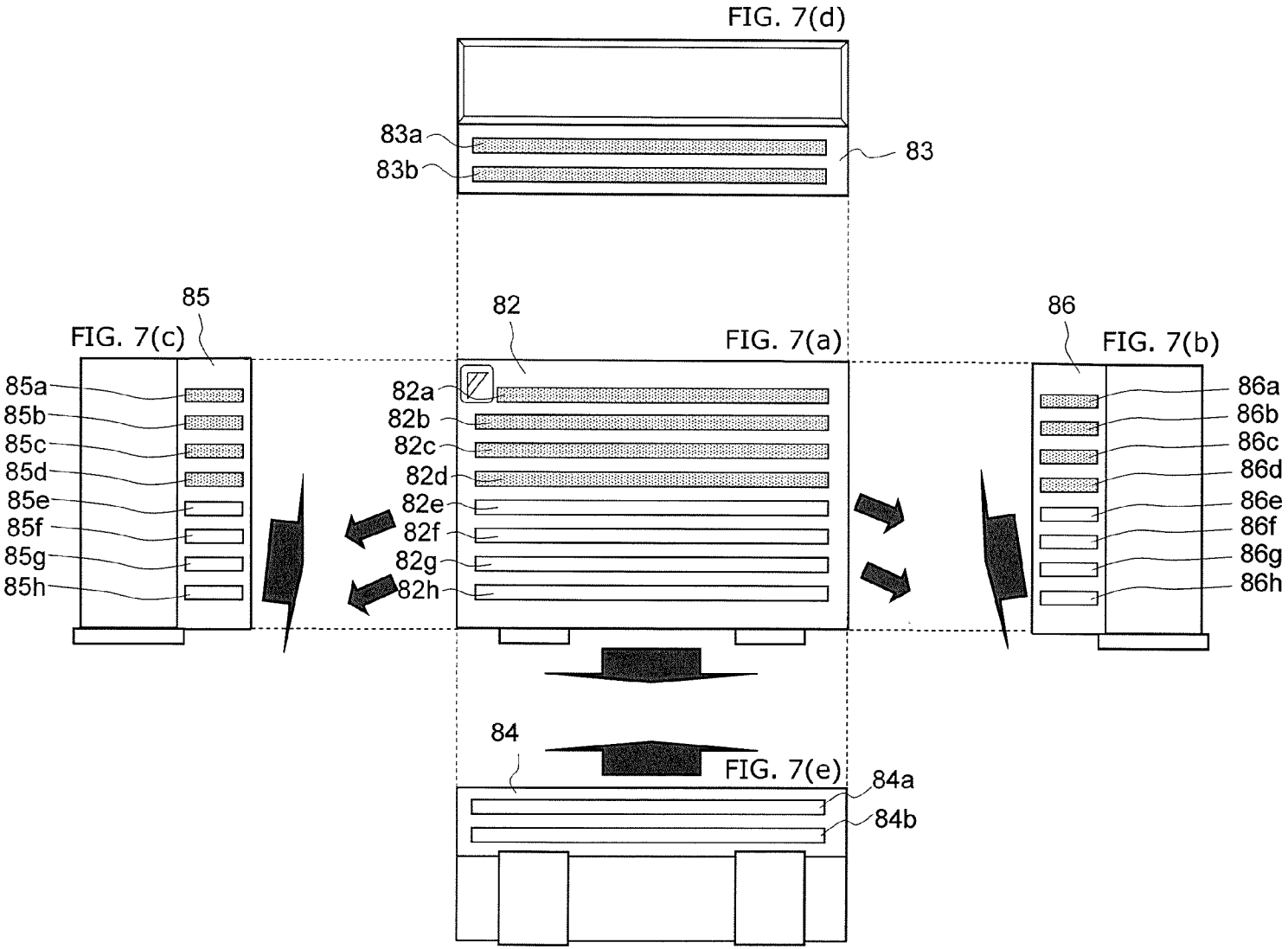
FIG. 7(*a*) is a view of the front surface of the outdoor unit in (a-3) of another embodiment (a).

(a-3) Blocking of Expulsion Openings Positioned in the Upper Half of the Mounting Member FIG. 7 shows the outdoor unit 1 for the case in which expulsion openings 82*a* to 82*d*, 85*a* to 85*d*, 86*a* to 86*d* in the upper half of the front surface 82 and the two side surfaces 85, 86 of the mounting member 81, and the expulsion openings

83*a* and 83*b* of the upper surface 83 are blocked by the closing member 87. In accordance with this outdoor unit 1, air from the casing 2 is expelled through the unblocked expulsion openings of the mounting member 81 (i.e., the expulsion openings 82*e* to 82*h*, 85*e* to 85*h*, 86*e* to 86*h* positioned in the lower half of the front surface 82 and the two side surfaces 85, 86; and the expulsion openings 84*a* and 84*b* of the lower surface 84) to the exterior of the outdoor unit 1, as indicated by the arrow in FIG. 7.

(b)

Described in the embodiment above is an example of the case in which the expulsion openings 82*a* to 82*h*, 83*a* and 83*b*, 84*a* and 84*b*, 85*a* to 85*h*, 86*a* to 86*h* are formed in all the surfaces of the mounting member 81. However, the expulsion openings may be formed in at least two surfaces of the mounting member rather than being formed in all the surfaces of the mounting member. Other examples include the case in which the expulsion openings are formed only in the front surface and the upper surface of the mounting member, and/or the case in which the expulsion openings are formed only in the two side surfaces of the mounting member. In these cases as well, the expulsion openings are suitably blocked by the closing member, whereby air inside the casing of the outdoor unit is expelled in a desired direction.

(c)

Figures 8A, 8B, 8C, 8D, 8E:
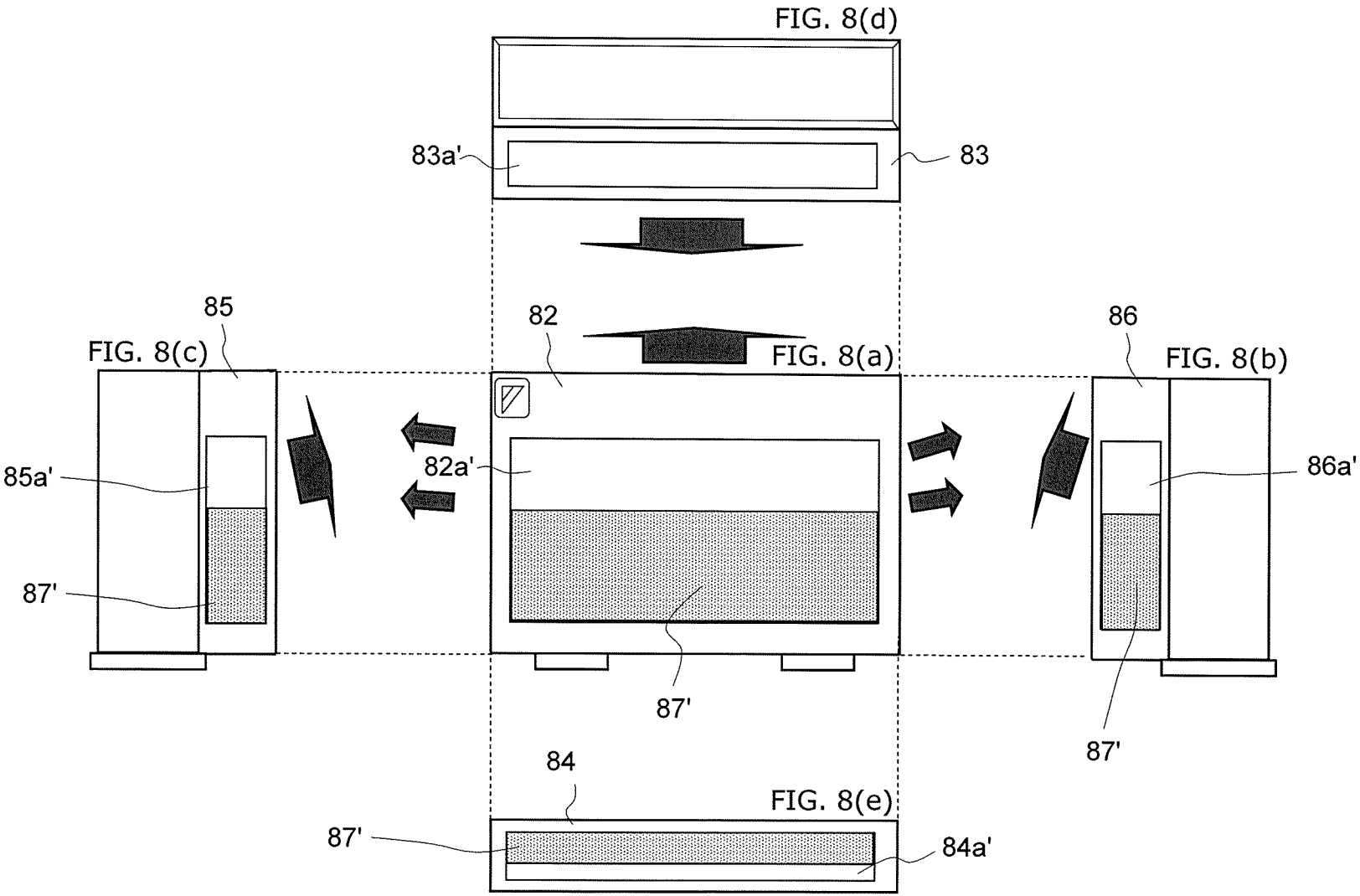
FIG. 8(*a*) is a view of the front surface of the outdoor unit in another embodiment (c).

Described in the embodiment above is an example of the case in which a plurality of expulsion openings are provided in each of the surfaces of the mounting member 81 (e.g., eight expulsion openings 82*a* to 82*h* are provided in the front surface 82 of the mounting member 81). However, by way of example, individual expulsion openings 82*a*' to 86*a*' may be provided in each of the surfaces 82 to 86 of the mounting member, as shown in FIG. 8. In this case, a closing member 87' suitably blocks a portion of the expulsion openings 82*a*' to 86*a*', thereby achieving the same effect as that of the embodiment described above.

(d)

Figure 9:
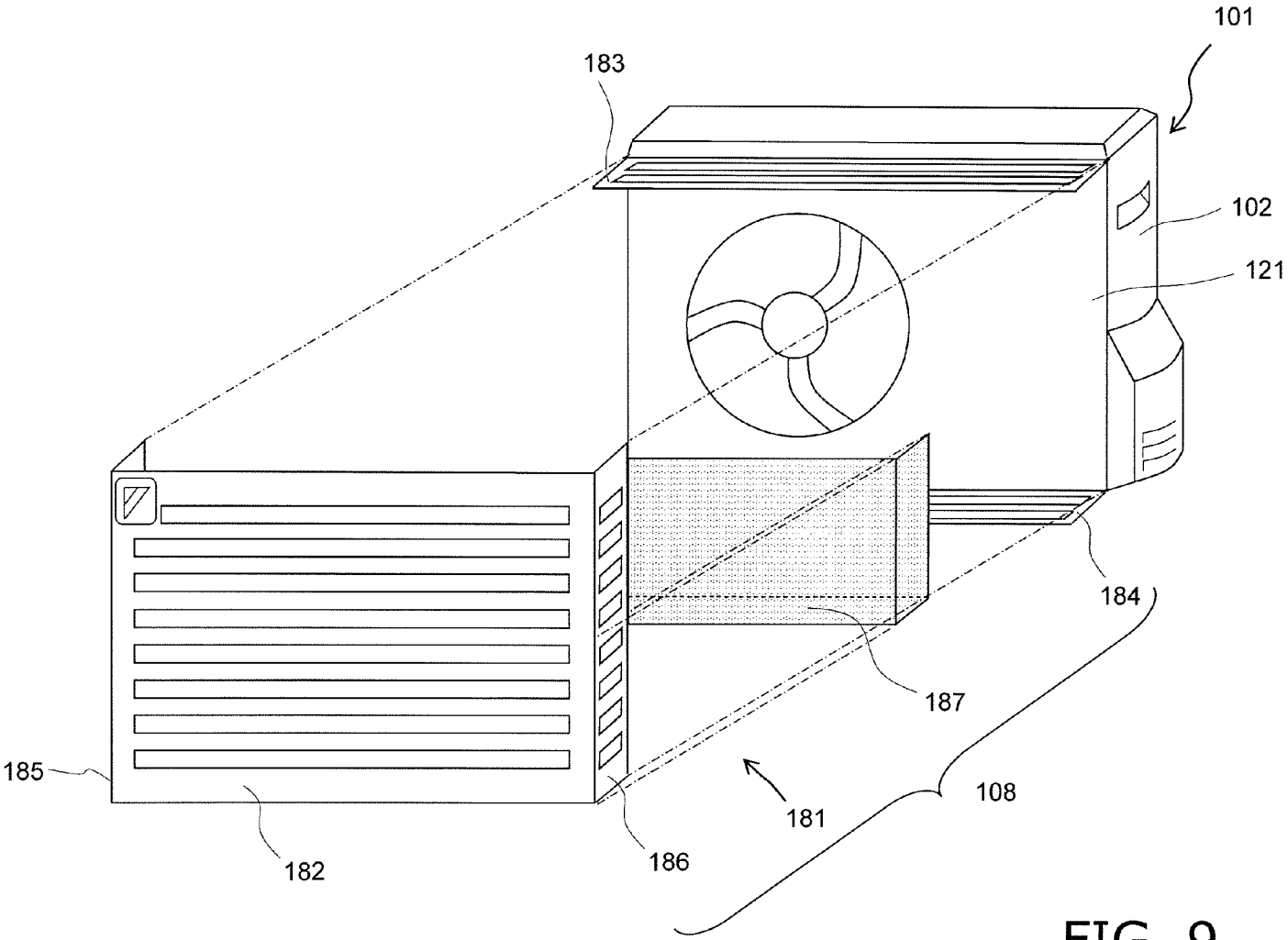
FIG. 9 is an exploded perspective view of the outdoor unit of another embodiment (d).

Described in the embodiment above is an example of the case in which the airflow-direction adjustment unit 8 and the casing 2 are separate, as shown in FIG. 2, for example. However, the airflow-direction adjustment unit according to the present invention may be at least partially formed integrally with respect to the casing of the outdoor unit. Specifically, a case in which the upper surface and/or the lower surface in the mounting member of the airflow-direction adjustment unit is integrally formed with the casing will be described. As an example, FIG. 9 shows an outdoor unit 101 in which the upper surface 183 and the lower surface 184 in the mounting member 181 of the airflow-direction adjustment unit 108 are integrally formed with the casing 102 of the outdoor unit 101. The upper surface 183 and the lower surface 184 of the mounting member 181 extend so as to protrude from the upper portion and the lower portion, respectively, in the front surface 121 of the casing 102, to the front surface side. In contrast to the upper surface 183 and the lower surface 184, the front surface 182, the left side surface 185, and the right side surface 186 of the mounting member 181 are provided separately from the casing 102. The closing member 187 has a shape formed by the front surface, the lower surface, and the two side surfaces, in the same manner as the closing member 87 according to the first embodiment.

(e)

Described in the embodiment above is an example of the case in which the closing member 87 has a shape formed by the front surface, the lower surface, and the two side surfaces, as shown in FIG. 2. However, the closing member according to the present invention is not limited to the shape shown in FIG. 2; any structure is possible as long as it is capable of blocking expulsion openings in the mounting member. Other examples of the closing member according to the present invention include the structures shown in FIGS. 10 and 11.

Figure 10B:
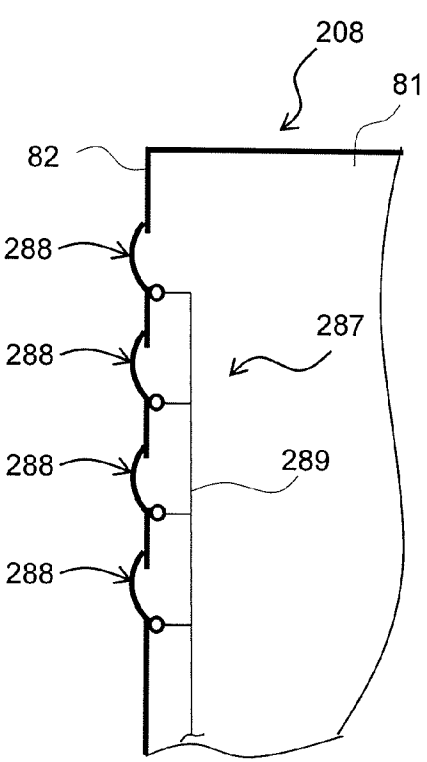
FIG. 10(*a*) is a view of the airflow-direction adjustment unit 208 according to another embodiment (e), and shows a portion of a longitudinal section of the airflow-direction adjustment unit 208 for a case in which the closing member 287 has opened each of the expulsion openings 82*a* to 82*d*.
Figure 10A:
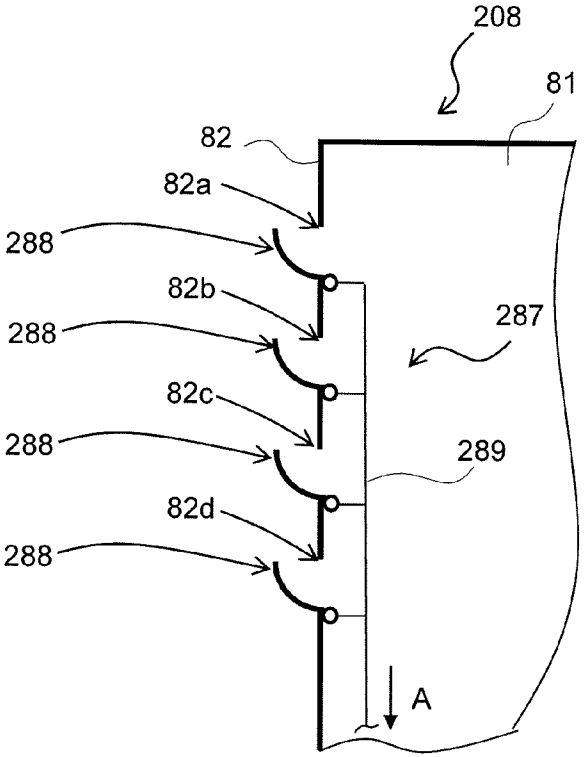

Specifically, the airflow-direction adjustment unit 208 according to FIG. 10 comprises a closing member 287 in place of the closing member 87 of the airflow-direction adjustment unit 8 according to the first embodiment. The airflow-direction adjustment unit 208 comprises the same mounting member 81 as the first embodiment. The closing member 287 has a plurality of closing plates 288 provided in correspondence with the expulsion openings 82*a* to 82*d*, . . . , respectively, of the mounting member 81, and a connecting part 289 that connects the closing plates 288. The closing plates 288 are arranged so as to be capable of blocking the expulsion openings 82*a* to 82*d*, . . . , from the outer side of the mounting member 81, a portion of each closing plate being supported in the vicinity of the expulsion openings 82*a* to 82*d*, . . . , of the mounting member 81. The closing plates 288 can be rotated using the portion supported by the mounting member 81 as a rotation support point, and such rotation allows each expulsion opening 82*a* to 82*d*, . . . to be opened and closed. The connecting part 289 adjusts the open/close state of the expulsion openings 82*a* to 82*d* that is brought about by the closing plates 288. For example, the connecting part 289 is pulled downward (in the direction of the arrow A in FIG. 10(*a*)) when the closing plates 288 have the expulsion openings 82*a* to 82*d* open, as shown in FIG. 10(*a*), whereby the closing plates 288 can be set in a state in which the expulsion openings 82*a* to 82*d*, . . . are blocked (FIG. 10(*b*)). In FIG. 10, the closing member 287 in the front surface 82 of the mounting member 81 is shown as an example.

Figure 11B:
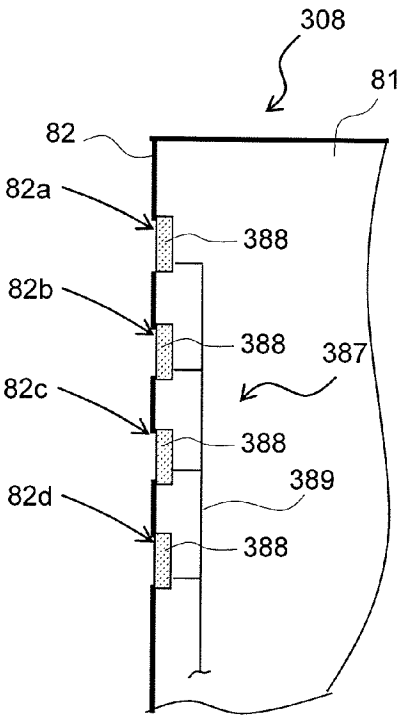
FIG. 11(*a*) is a view of the airflow-direction adjustment unit 308 according to another embodiment (e), and shows a portion of a longitudinal section of the airflow-direction adjustment unit 308 for the case in which the closing member 387 has opened each of the expulsion openings 82*a* to 82*d*.
Figure 11A:
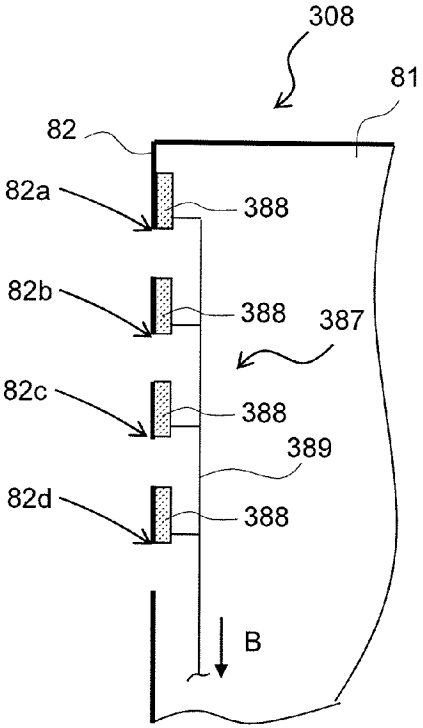

The airflow-direction adjustment unit 308 according to FIG. 11 has a closing member 387 in place of the closing member 87 of the airflow-direction adjustment unit 8 according to the first embodiment. The airflow-direction adjustment unit 308 comprises the same mounting member 81 as the first embodiment. The closing member 387 comprises a plurality of closing plates 388 provided in correspondence with the expulsion openings 82*a* to 82*d*, . . . , respectively, and a connecting part 389 that connects the closing plates 388. The closing plates 388 are supported by a rail or the like (not shown) in the vicinity of the expulsion openings 82*a* to 82*d*, . . . of the mounting member 81 and can slide to open and close the expulsion openings 82*a* to 82*d*, . . . from inside the mounting member 81. The connecting part 389 adjusts the open/close state of the expulsion openings 82*a* to 82*d* that is brought about by the closing plates 388. For example, the connecting part 389 is pulled downward (in the direction of the arrow B in FIG. 11(*a*)) when the closing plates 388 have the expulsion openings 82*a* to 82*d*, . . . open, as shown in FIG. 11(*a*), whereby the closing plates 388 can be set in a state in which each of the expulsion openings 82*a* to 82*d*, . . . are closed (blocked) (FIG. 11(*b*)). In FIG. 11, the closing member 387 in the front surface 82 of the mounting member 81 is shown as an example.

As described above, with the airflow-direction adjustment units 208, 308 according to FIGS. 10 and 11, at least some of the closing members 287, 387 are supported by the mounting member 81, and the closing members 287, 387 block the expulsion openings 82*a* to 82*d*, . . . by moving in a relative fashion with respect to the mounting member 81. Such a structure makes it possible to respond promptly to customer requirements even at the time the outdoor unit is being installed, without the need to form the closing member 87 or decide whether the closing member 87 is necessary after the installation position of the outdoor unit 1 has actually been confirmed as in the first embodiment. It is also possible to respond rapidly and flexibly in cases where the environmental state around the installation position of the outdoor unit has changed.

INDUSTRIAL APPLICABILITY

The airflow-direction adjustment unit of the present invention has the effect of allowing air to be expelled in a desired direction. Therefore, in a heat source unit of a refrigeration apparatus such as a heat pump unit or the like of a water heater and an outdoor unit of an air conditioning apparatus, the airflow-direction adjustment unit can be used for adjusting the direction of air expelled to the exterior from the main body of the heat source unit.

What is claimed is:

1. An airflow-direction adjustment unit configured to adjust direction of air expelled to an exterior from a main body of a heat source unit of a refrigeration apparatus, the airflow-direction adjustment unit comprising:

a mounting member having at least one expulsion opening arranged and configured to expel the air from the heat source unit main body, the mounting member being mounted on the heat source unit main body; and a closing member arranged and configured to block some portion of the at least one expulsion opening while the air is being expelled from the heat source unit main body.

2. The airflow-direction adjustment unit according to claim 1, wherein the heat source unit main body is arranged and configured to blow air out of a front surface thereof;

the mounting member is a box-shaped member mounted on the front surface of the heat source unit main body; and the at least one expulsion opening is disposed at two or more surfaces of the mounting member, the two or more surface of the mounting member being selected from a front surface, an upper surface, a lower surface, and two side surfaces of the mounting member.

3. The airflow-direction adjustment unit according to claim 1, wherein the closing member is at least partially supported by the mounting member, and the closing member is further arranged and configured to block the at least one expulsion opening in response to movement relative to the mounting member.

4. A heat source unit of a refrigeration apparatus including the airflow-direction adjustment unit according to claim 1, the heat source unit further comprising:

a heat source unit main body relative to which the airflow-direction adjustment unit is arranged to adjust the direction of air expelled to the exterior from the heat source unit main body, the heat source unit main body accommodating a heat exchanger and a fan, with the heat exchanger being arranged and configured to exchange heat with the air, and the fan being arranged and configured to deliver the air that has undergone heat exchange in the heat exchanger to the at least one expulsion opening.

5. The heat source unit of a refrigeration apparatus according to claim 4, wherein the heat source unit main body and at least a portion of the mounting member of the airflow-direction adjustment unit are integrally formed together.

6. The airflow-direction adjustment unit according to claim 2, wherein the closing member is at least partially supported by the mounting member, and the closing member is further arranged and configured to block the at least one expulsion opening in response to movement relative to the mounting member.

7. A heat source unit of a refrigeration apparatus including the airflow-direction adjustment unit according to claim 6, the heat source unit further comprising:

a heat source unit main body relative to which the airflow-direction adjustment unit is arranged to adjust the direction of air expelled to the exterior from the heat source unit main body, the heat source unit main body accommodating a heat exchanger and a fan, with the heat exchanger being arranged and configured to exchange heat with the air, and the fan being arranged and configured to deliver the air that has undergone heat exchange in the heat exchanger to the at least one expulsion opening.

8. The heat source unit of a refrigeration apparatus according to claim 7, wherein the heat source unit main body and at least a portion of the mounting member of the airflow-direction adjustment unit are integrally formed together.

9. A heat source unit of a refrigeration apparatus including the airflow-direction adjustment unit according to claim 2, the heat source unit further comprising:

a heat source unit main body relative to which the airflow-direction adjustment unit is arranged to adjust the direction of air expelled to the exterior from the heat source unit main body, the heat source unit main body accommodating a heat exchanger and a fan, with the heat exchanger being arranged and configured to exchange heat with the air, and the fan being arranged and configured to deliver the air that has undergone heat exchange in the heat exchanger to the at least one expulsion opening.

10. The heat source unit of a refrigeration apparatus according to claim 9, wherein the heat source unit main body and at least a portion of the mounting member of the airflow-direction adjustment unit are integrally formed together.

11. A heat source unit of a refrigeration apparatus including the airflow-direction adjustment unit according to claim 3, the heat source unit further comprising:

a heat source unit main body relative to which the airflow-direction adjustment unit is arranged to adjust the direction of air expelled to the exterior from the heat source unit main body, the heat source unit main body accommodating a heat exchanger and a fan, with the heat exchanger being arranged and configured to exchange heat with the air, and the fan being arranged and configured to deliver the air that has undergone heat exchange in the heat exchanger to the at least one expulsion opening.

12. The heat source unit of a refrigeration apparatus according to claim 11, wherein the heat source unit main body and at least a portion of the mounting member of the airflow-direction adjustment unit are integrally formed together.

13. An airflow-direction adjustment unit configured to adjust direction of air expelled to an exterior from a main body of a heat source unit of a refrigeration apparatus, the airflow-direction adjustment unit comprising:

a mounting member having a plurality of expulsion openings arranged and configured to expel the air from the heat source unit main body, the mounting member being mounted on the heat source unit main body; and a closing member arranged and configured to block some but not all of the plurality of expulsion openings while the closing member is in a first predetermined orientation relative to the mounting member.

14. An airflow-direction adjustment unit configured to adjust direction of air expelled to an exterior from a main body of a heat source unit of a refrigeration apparatus, the airflow-direction adjustment unit comprising:

a mounting member having at least one expulsion opening arranged and configured to expel the air from the heat source unit main body, the mounting member being mounted on the heat source unit main body; and a closing member arranged and configured to block a portion but not the entirety of the at least one expulsion opening while the closing member is in a first predetermined orientation relative to the mounting member.

* * * * *